United States Patent [19]

Bayer et al.

[11] Patent Number: 4,863,030

[45] Date of Patent: Sep. 5, 1989

[54] PRESS-ON, TWIST-OFF PLASTISOL-LINED METAL CLOSURE

[75] Inventors: John W. Bayer; Paul W. Dullabaun, both of Toledo, Ohio; Zbigniew Swierczek, Temperance, Mich.

[73] Assignee: Anchor Hocking Corporation, Lancaster, Ohio

[21] Appl. No.: 226,492

[22] Filed: Aug. 1, 1988

[51] Int. Cl.[4] ..... B65D 41/22

[52] U.S. Cl. ..... 206/427; 215/318

[58] Field of Search ..... 215/318, 346, 348, 334; 206/427

[56] References Cited

U.S. PATENT DOCUMENTS

| | | | |
|---|---|---|---|
| 3,270,904 | 9/1966 | Foster et al. | 215/318 |
| 3,371,813 | 3/1968 | Owen et al. | 215/318 |
| 3,448,881 | 6/1969 | Zipper | 215/318 |
| 3,685,677 | 8/1972 | Westfall | 215/318 |
| 3,690,497 | 9/1972 | Lecinski, Jr. | 215/346 X |
| 3,741,423 | 6/1973 | Acton et al. | 215/318 |
| 4,000,825 | 1/1977 | Westfall | 215/318 |
| 4,552,279 | 11/1985 | Mueller et al. | 215/318 |
| 4,576,299 | 3/1986 | Lecinski, Jr. | 215/318 |
| 4,603,786 | 8/1986 | Lecinski, Jr. | 215/318 |
| 4,615,443 | 10/1986 | Deffner et al. | 206/427 |

*Primary Examiner*—Donald F. Norton

*Attorney, Agent, or Firm*—Thomas A. Meehan

[57] ABSTRACT

A plastisol-lined metal closure of the press-on, twist-off type and having improved top load resistance to permit containers capped with such closures to be packaged in open top trays, the plastisol lining having a density of at least approximately 58 pounds per cubic foot, and in a closure for a 51 millimeter container, a thickness in the container rim engaging portion thereof, before application to the container, of at least approximately 0.024 inch, a thickness in the portion thereof which engages the portion of the container finish below the threaded portion of the finish, before application to the container, of at least approximately 0.025 inch, and a thickness in the portion thereof which engages the portion of the container finish above the threaded portion, before application to the container, of no greater than approximately 0.026 inch.

24 Claims, 3 Drawing Sheets

PRESS-ON, TWIST-OFF PLASTISOL-LINED METAL CLOSURE

BACKGROUND OF THE INVENTION

1. Field of the Invention

This invention relates to a plastisol-lined metal closure of the type which may be applied to a helically threaded finish of a glass or rigid plastic container by a press-on action, but which may be normally removed from the finish of the container only by a twisting action. More particularly, this invention relates to a press-on, twist-off plastisol-lined metal closure with improved top load resistance.

2. Description of the Prior Art

U.S. Pat. No. 4,552,279 (Mueller, et al.), which is assigned to the assignee of this application, describes a press-on, twist-off closure which is made up of a cup-shaped metal closure with a foamed vinyl plastisol material which is cast in situ within the closure to cover a portion of the inside of a base wall of the closure and a surrounding peripheral wall, to thereby engage the top rim and a portion of the side of the finish of a container upon the application of the closure to the container. After operations to shape and cure the plastisol lining of the closure, the closure is pressed upon the externally threaded finish of the container, the threads of the container forming threads in the plastisol lining after the application of the closure to the container to preclude normal removal of the closure from the container other than by a twisting action. Containers capped with closures of this type have heretofore been packaged in closed top corrugated fibreboard trays, each of the trays being closed by the infolding of top flaps at the tops of the side walls of the trays, as is known in the art. Even though such trays are usually superimposed several deep during shipment and storage, such closures, which are normally flush with the top of the tray and which, therefore, bear a part of the weight of the filled tray or trays thereabove, provide satisfactory top load resistance to those superimposed filled trays, but to a substantial extent as a result of the cushioning effect of the top structure of the closed top of the tray, which serves to fairly evenly distribute the superimposed loads from container to container within the tray and around the circumference of the closure on each container in the tray.

One of the recent advances in the packaging field is the use of open top trays in the packaging of containers closed with press-on, twist-off closures, since trays of this type use appreciably less corrugated fibreboard than their closed top counterparts and are, hence, appreciably less expensive. However, the use of open top trays can result in greater and less evenly distributed top loads on the closures of the containers packaged in any such tray which may be at or near the bottom of a stack of such trays, and this can result in a failure of the seal between any such closure and the container to which it is affixed. This problem can be particularly annoying when closures are used in the packaging of a liquid, for example, an infant juice formulation, which is a packaging application that frequently uses plastisol-lined closures.

U.S. Pat. No. 4,576,299 (Lecinski, Jr.) describes a press-on, twist-off plastisol-lined metal closure which claims to have improved top load leakage resistance. However, it is believed that closures according to this reference do not have adequate top load leakage resistance for use in many applications where the containers capped with such closures are packed in open top corrugated trays. Other types of press-on, twist-off lined metal closures are illustrated in U.S. Pat. Nos. 3,270,904 (C. N. Foster, et al.) 3,371,813 (R. C. Owen, et al.), 3,448,881 (D. H. Zipper), 3,685,677 (Westfall), 3,690,497 (Lecinski, Jr.), 3,741,423 (Acton, et al.), 4,000,825 (Westfall), and 4,603,786 (Lecinski, Jr.), but it is believed that closures of each of these references lack adequate top load leakage resistance for use on containers packaged in open top trays.

SUMMARY OF THE INVENTION

According to the present invention, there is provided a plastisol-lined metal closure of the press-on, twist-off type which, through the use of a plastisol having a somewhat greater density than the density of prior art closures, and through the use of a different contour of the plastisol in relation to the plastisol contour of prior art closures, to provide a thicker plastisol portion in engagement with the top sealing surface of the associated container, a thicker plastisol portion in engagement with the lower part of the finish of the container, and a thinner plastisol portion in engagement with the upper part of the finish of the container, enhances the top load leakage resistance of the capped containers to permit them to be packaged in open top corrugated trays, notwithstanding the common practice of stacking such trays several deep during shipment and storage. Closures according to the present invention are particularly well suited for use in conjunction with containers having 51 millimeter finishes (the finish dimension of a container is the approximate diameter at the outside of the thread of the container, and is frequently referred to as the "T" dimension in the terminology of the Glass Packaging Institute, a prominent glass container industry trade association), and closures of this type and size preferably use a plastisol formulation with reduced foaming agent in relation to conventional plastisol-lined closures to achieve a plastisol density of at least approximately 58 pounds/cubic foot, as opposed to a density of approximately 52 pounds/cubic foot for a conventional plastisol-lined closure.

Accordingly, it is an object of the present invention to provide an improved plastisol-lined metal closure of the press-on, twist-off type, and it is a corollary object to provide a package which is made up of a container with a closure of the foregoing character affixed to a finish portion thereof. It is a further object of the present invention to provide a plastisol-lined metal closure of the press-on, twist-off type with improved top load leakage resistance in relation to plastisol-lined press-on, twist-off metal closures of the prior art, and it is a corollary object of the present invention to provide a package which is made up of a container with a closure of the foregoing character affixed to a finish portion thereof. It is yet a further object of the present invention to provide a plastisol-lined metal closure of the press-on, twist-off type which may be used in the capping of containers which are to be packaged in open top trays to provide improved top load leakage resistance to each such container/closure combination to permit such open top trays to be stacked several deep without resulting in product leakage from any of the containers, and it is a corollary object of the present invention to provide a container with a closure of the foregoing character affixed to a finish portion thereof. Finally, it is an object of the present invention to provide a package which is made up of an open top tray having a plurality of filled containers, each of which is capped with a plastisol-lined metal closure of the press-on, twist-off type in which each such container/closure combination has improved top load leakage resistance to permit several of such trays to be stacked without leakage of any of the containers in a tray at or near the bottom of the stack, and it is a corollary object to provide a stack of a plurality of superimposed packages of the foregoing character.

For a further understanding of the present invention and the object thereof, attention is directed to the drawing and the following brief description thereof, to the description of the preferred embodiment, and to the appended claims.

DETAILED DESCRIPTION OF THE PREFERRED EMBODIMENT

Figure 9:
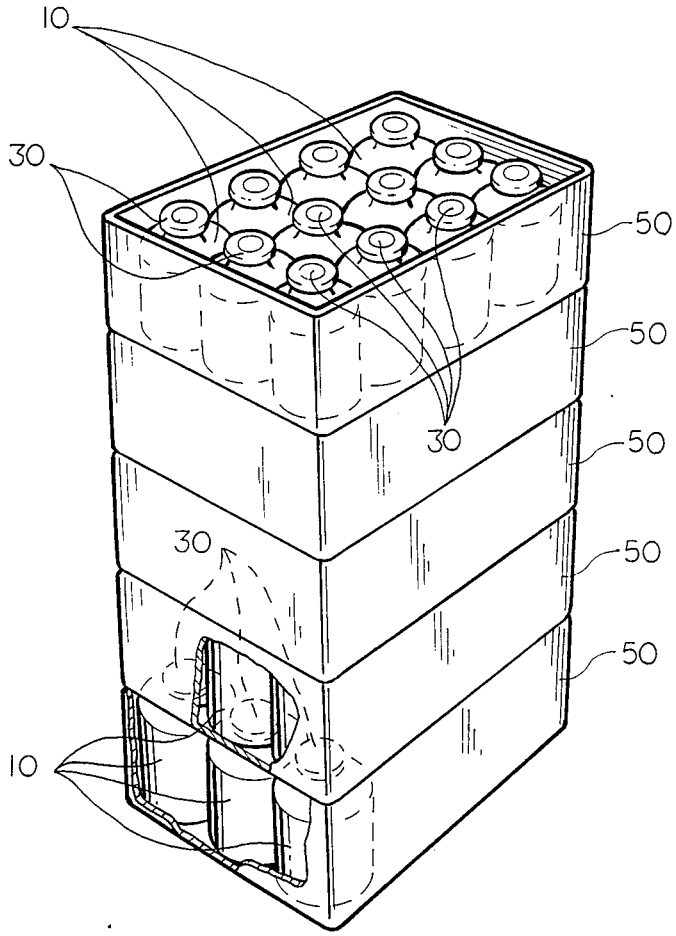
FIG. 9 is a perspective view illustrating a stack of open top corrugated trays, each of which contains a plurality of capped containers of the type illustrated in FIG. 1.

As is shown in the drawing, a capped container is indicated generally by reference numeral 10, and each capped container 10 is made up of a container 20, for example, a blown glass bottle or rigid blow-molded plastic bottle, and a closure 30 sealingly affixed to a finish 22 of the container 20. As is illustrated in FIG. 9, a multiplicity of capped containers 10 are packaged in an open top corrugated fibreboard tray 50 with the top of each capped container 10 being at least as high as the open top of the tray 50 in which it is packaged. As illustrated, it is customary to stack trays 50 with capped containers 10 several deep, a practice which can result in the imposition of substantial top loads on individual capped containers 10 in a tray 50 at or near the bottom of the stack, and these loads can be unevenly applied from capped container 10 to capped container 10 within a tray 50 or around a circumference of the closure 30 on a particular capped container 10 due to misalignment of the trays 50 in the stack, for example. Capped containers 10 of the type illustrated are frequently used in the packaging of a liquid product, for example, an infant juice formulation, and in any such packaging application it is important to be able to maintain a liquid-tight seal between the container 20 and the closure 30 of each capped container 10 to avoid leakage of the packaged product, and to be able to do so in spite of a substantial or unevenly applied top load on such capped container 10.

Figure 1:
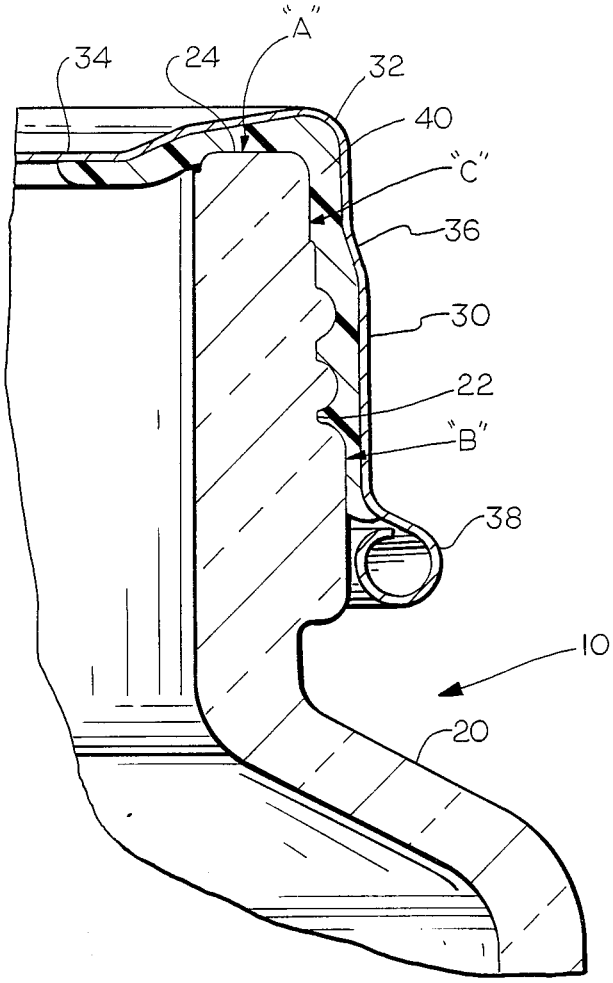
FIG. 1 is a fragmentary view, in vertical section, of a container having a closure according to the preferred embodiment of the present invention affixed thereto in sealing relationship.

Each closure 30 is generally cup-shaped, and includes a closure shell 32 which is formed in a single piece from a metal sheet such as tin-plated steel or aluminum. The closure shell 32 which has a top panel portion 34 and a peripheral skirt portion 36 surrounding the top panel portion, the skirt portion 36 terminating in a rolled rim 38 at its free end. The closure 30 also includes a gasket 40 of foamed vinyl plastisol material which is cast in situ within the closure shell 32 and extends along an annular outer portion of the top panel portion 34 and the portion of the peripheral skirt portion 36 that is adjacent to the top panel portion 34. Thus, a gasket 40 sealingly engages a top rim portion 24 of the finish 22 and an upper side portion of the finish 22 of the container 20, including outwardly projecting and helically extending thread means 26, which may be a single thread or a multiple start helical thread, as is known in the prior art, when the closure 30 is securely affixed to the container 20, as illustrated in FIG. 1.

Closures 30 of the type illustrated are suited for application to glass containers filled with an infant juice formulation, a packaging application that frequently uses glass containers with 51 millimeter diameter finishes. Another popular container type which frequently is capped with a plastisol-lined press-on, twist-off metal closure has a 48 millimeter diameter finish. In any case, the gasket 40 is formed from a plastisol composition with a relatively high density, that is, a density of at least 58 pounds/cubic foot, and preferably approximately 58–62 pounds/cubic foot, in order to be able to accommodate the top loads which can be experienced by closures 30 when the filled containers incorporating such closures are packaged in open top trays.

In order to be able to provide adequate top load resistance, the portion of the plastisol gasket which engages the top rim portion 24 of the finish 22 of the container 20, in a closure for a 51 millimeter container, shown as location "A" in the drawing, has a thickness, before application to the container 20, of at least approximately 0.024 inch, in relation to a thickness of approximately 0.014 inch in a corresponding conventional, prior art plastisol-lined metal closure, and it has a thickness, before application to the container 20, of at least approximately 0.025 inch at the location of the lower portion of the finish 22 of the container 20, that is, the portion of the finish 22 below the thread 26, corresponding to the inside of the peripheral skirt portion 34 of the closure 30 and immediately above the rolled rim 36 portion thereof, shown as location "B" in the drawing, in relation to a thickness of approximately 0.015 inch in a corresponding conventional, prior at plastisol-lined metal closure. The added thickness of the plastisol gasket 40 at location "A" helps to more evenly distribute any unevenly distributed loading on the top of the closure 30 on the container 20, and the added thickness of the plastisol gasket at location "B" helps to provide more lateral support for the closure 30 on the container 20 in the region of the thread 26 on the finish 22. Further, the thickness of the plastisol lining 40 in the region above the thread 26 on the finish 22, shown as location "C" drawing, is a little thinner than a conventional, prior art plastisol-lined metal closure, being approximately 0.026 inch in the preferred embodiment of the closure in the present invention as opposed to approximately 0.031 inch in such a prior art closure. The reduced plastisol thickness at location "C" serves to ensure that the seal which forms between the closure 30 and the container 20 when the closure 30 is applied thereto preferentially occurs at the rim 24 of the finish 22 rather than along the side of the finish 22.

In the preferred embodiment of the present invention the composition and properties of the plastisol gasket 40 are shown in the following table in relation to the composition and properties of a prior art plastisol gasket material for a conventional plastisol-lined metal closure.

TABLE

| Concentration (parts per hundred resin) | Prior Art | Present Invention |
|---|---|---|
| PVC homopolymer dispersion | 80 | 80 |
| PVC homopolymer blending | 20 | 20 |
| calcium zinc stabilizer | 1.5 | 1.5 |
| azodicarbonamide foam agent | 0.4 | 0.24 |
| $TiO_2$ pigment | 1.0 | 1.0 |
| fatty acid triglyceride | 3.0 | 3.0 |
| oleamide | 3.0 | 3.0 |
| erucamide | 5.0 | 5.0 |
| dimethyl silicone fluid | 1.0 | 1.0 |
| lauryl alcohol | 2.5 | 2.5 |
| expoxidized soybean oil | 55 | 55 |
| Properties | | |
| liquid density | 9.8 lb/gal. | 9.8 lb/gal. |
| film density | 52 lb/cu.ft. | 60 lb/cu.ft. |
| viscosity (Severs, 40 p.s.i., 125°) | 2800 | 2800 |

As is apparent from the foregoing table, the plastisol composition of this invention differs from the corresponding prior art composition in that the composition of this invention utilizes reduced foam agent which results in an increase in its film density.

Figure 2:
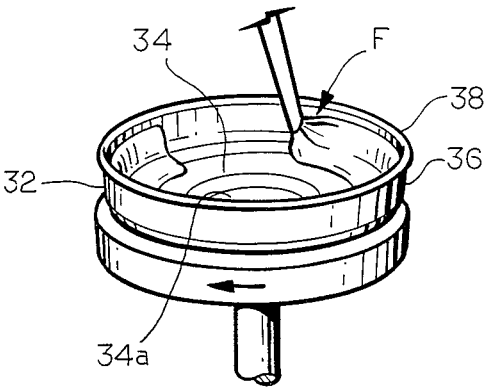
FIG. 2 is a fragmentary perspective view illustrating a step in the manufacture of the closure of FIG. 1.
Figure 3:
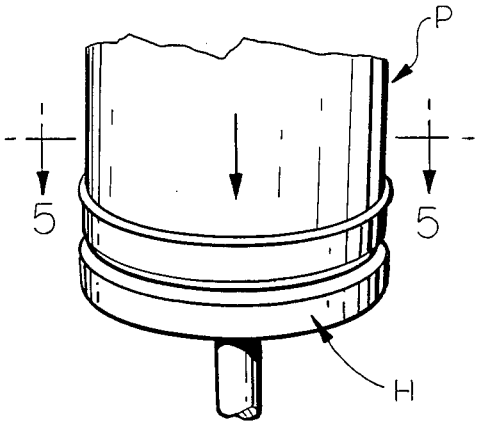
FIG. 3 is a fragmentary perspective view illustrating a step subsequent to the step illustrated in FIG. 2 in the manufacture of the closure of FIG. 1.
Figure 4:
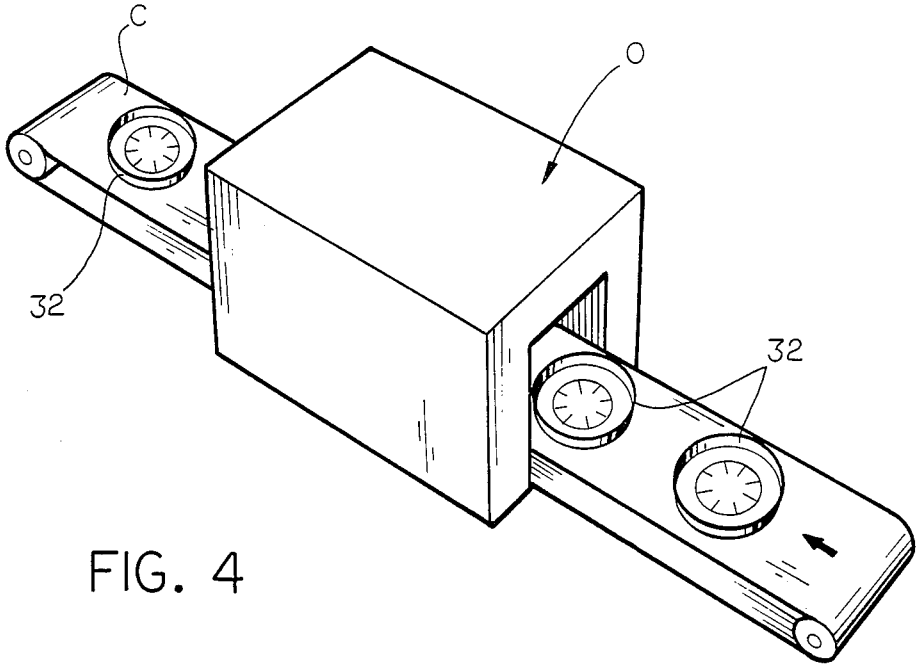
FIG. 4 is a perspective view illustrating another step subsequent to the step illustrated in FIG. 3 in the manufacture of a multiplicity of closures of the type illustrated in FIG. 1.
Figure 5:
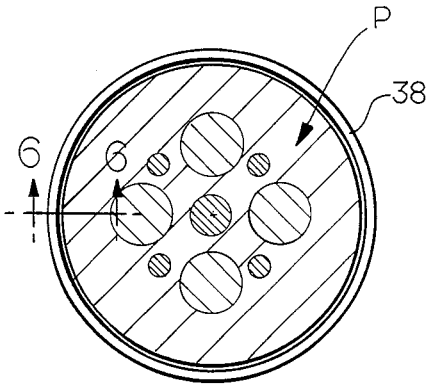
FIG. 5 is a horizontal sectional view taken on line 5—5 of FIG. 3.
Figure 6:
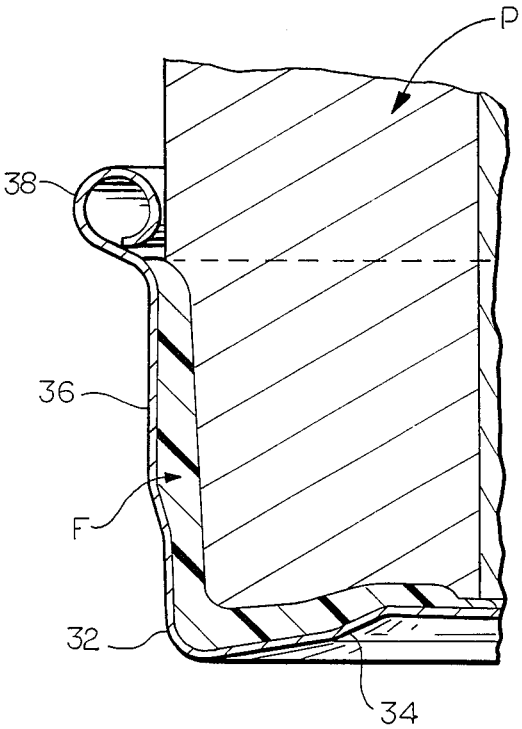
FIG. 6 is a fragmentary perspective view, at an enlarged scale, taken on line 6—6 of FIG. 5.

As is shown in FIG. 2 of the drawing, the manufacture of the closure 30 involves the step of flowing a wet, uncured plastisol dissolved formulation "F" into an inverted, spinning metal closure shell 32 so that the plastisol forms in annular mass at the juncture of a panel portion 34 and the peripheral skirt portion 36 on the inside of the closure shell 32. Then, as is shown in FIGS. 3 and 5, a heated plunger "P" is forced axially into the closure 32 while the closure shell 32 is on a heated plate "H", the plunger "P" being contoured to properly shape the plastisol formulation "F" to conform to the shape of the plastisol gasket 40, as heretofore described. The heated plunger "P" is then removed, and, as is shown in FIG. 4, the closure shell 32 is then transferred to a conveyor "C" for conveying of a multiplicity of such closure shells 32, in sequence, through a heated oven "O" to cure the plastisol formulation "F" in each such closure shell. The curing of the plastisol formulation "F" will result in a slight expansion thereof into the final shape of the plastisol gasket 40 due to the presence of a foaming agent in the plastisol formulation "F", for example, the azodicarbonamide foaming agent of the composition described in the foregoing table. In that regard, compare FIGS. 6 and 8 of the drawing.

Figure 8:
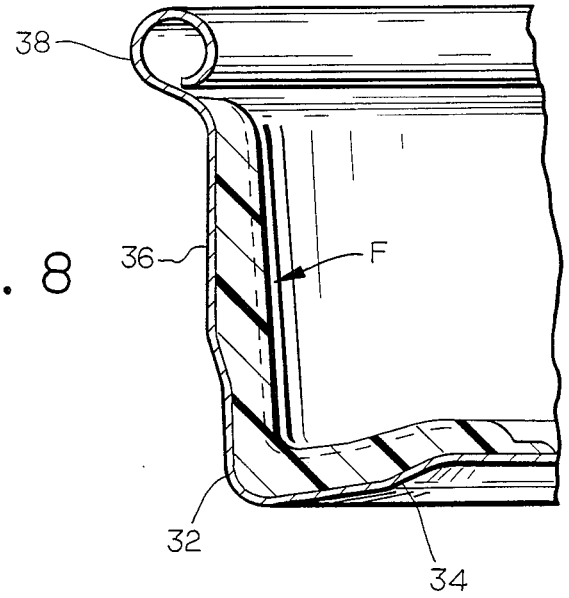
FIG. 8 is a fragmentary perspective view, at an enlarged scale, taken on line 8—8 of FIG. 7.
Figure 7:
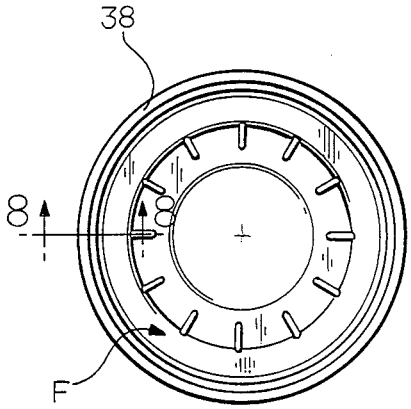
FIG. 7 is a plan view at a reduced scale of the inside of the closure illustrated in FIG. 1.

After completion of the manufacture of the closure 30, when it has the configuration shown in FIG. 8, it is inverted to the position shown in FIG. 1 and is then applied to the finish 22 of a container 20 by a firm pressing action to ensure that the rim 24 of the container 20 penetrates deeply into the plastisol gasket 40, as shown in FIG. 1. This will ensure the forming of a proper seal between the plastisol gasket 40 and the rim 24 of the container 20. The application of the closure 30 to the container 20 may be accomplished without the need for twisting action, since the plastisol gasket 40 is sufficiently flowable to pass over the thread 26 in spite of the interference fit therebetween, and to then reshape itself through the mechanism of cold flow to conform to the shape of finish 22 of the container 20, including the helical thread 26. Thus, after the normal time delay for the capped container to travel from a packing plant to a consumer, a time which is normally at least of the order of several days and is frequently of the order of several weeks, the consumer can readily remove the closure 30 from the container 20 only by a twisting action.

In the application of closures 30 to containers 20, the containers 20 are normally filled with a hot product, and are normally filled only to a predetermined level leaving an unfilled portion at the top of the container 20, which is commonly referred to as the "headspace", as is conventional in the packaging art. Upon the cooling of the product after it has been filled into the container 20 while the product is at an elevated temperature, if a proper seal forms between the closure 30 and the container 20, a slightly subatmospheric pressure will develop in the headspace of the filled container 20, and this will help to develop a proper seal between the plastisol gasket 40 and the finish 22 of the container 20. While not a part of the present invention, the top panel portion 34 in the closure shell 32 may be provided with a vacuum indicating button **34*a*, FIG. 2, which will be drawn into the headspace of the container 20** when a subatmospheric pressure is present therein, and which will pop out to a normal position with an audible click on the repressurization of the container headspace, which should not occur until the opening of the container by the consumer, which is a known feature of various prior art gasketed metal closures.

Although the best mode contemplated by the inventors for carrying out the present invention as of the filing date hereof has been shown and described herein, it will be apparent to those skilled in the art that suitable modifications, variations, and equivalents may be made without the parting from the scope of the invention, such scope being limited solely by the terms of the following claims:

We claim:

1. A closure for application to the finish of a container, the finish having a rim, at least one helically extending thread, a first portion between the at least one helically extending thread and the rim, and a second portion, the at least one helically extending thread being between the second portion and the rim, said closure being adapted to be applied to the container by an axial movement and removed from the container by a rotary movement, said closure comprising:

a shell having a top panel portion and a peripheral skirt portion depending generally normally from an outer portion of said top panel portion, said top panel portion having an inside and an outside, said peripheral skirt portion having an inside and an outside and being adapted to surround the finish of the container including the at least one helically extending thread when said closure is applied to the container with said inside of said top panel portion and said inside of said peripheral skirt portion facing the finish of the container; and a gasket of an expanded plastisol composition formed in situ along said inside of said peripheral skirt portion and said inside of said top panel portion along said outer portion thereof, said gasket being adapted to contact the rim of the container and the finish including the second portion, said gasket having a density of at least approximately 58 pounds per cubic foot and a thickness at a portion of said inside of said outer portion of said top panel portion which is adapted to be in alignment with the rim of the container, said thickness being measured, before application of said closure to the container, of at least approximately 0.024 inch.

2. A closure according to claim 1 wherein said gasket has a first thickness at a first location along said inside of said peripheral skirt portion which is adapted to contact the first portion of the finish and a second thickness at a second location along said inside of said peripheral skirt portion which is adapted to contact the second portion of the finish, and wherein said second thickness is at least approximately 0.025 inch when measured before application of said closure to the container.

3. A closure according to claim 2 wherein said first thickness is no greater than approximately 0.026 inch when measured before application of said closure to the container.

4. A closure according to claim 3 wherein the finish of the container has an outside diameter at the location of the at least one helically extending thread of approximately 51 millimeters.

5. A closure according to claim 4 wherein said shell is formed in a single piece from a sheet of a metallic material.

6. A closure according to claim 1 wherein said density of said gasket is approximately 58–62 pounds per cubic foot.

7. A capped container comprising:

a container having a finish, said finish having a rim, at least one helically extending thread, a first portion between said at least one helically extending thread and said rim, and a second portion, said at least one helically extending thread being between said second portion and said rim; and a closure sealingly applied to said finish of said container by an axial movement, said closure being adapted to be removed from said container by a rotary movement and comprising a shell having a top panel portion and a peripheral skirt portion depending generally normally from an outer portion of said top panel portion, said top panel portion having an inside and an outside, said peripheral skirt portion having an inside and an outside and surrounding said finish of said container including said at least one helically extending thread; and a gasket of an expanded plastisol composition formed in situ along said inside of said peripheral skirt portion and said inside of said top panel portion along said outer portion thereof, said gasket contacting said rim of said container and said finish including said second portion, said gakset having a density of at least approximately 58 pounds per cubic foot and a thickness at a portion of said inside of said outer portion of said top panel portion which is in alignment with said rim of said container, said thickness being measured before application of said closure to said container, of at least approximately 0.024 inch.

8. A capped container according to claim 7 wherein said gasket has a first thickness at a first location along said inside of said peripheral skirt portion which contacts said first portion of said finish and a second thickness at a second location along said inside of said peripheral skirt portion which contacts said second portion of said finish, and wherein said second thickness is at least approximately 0.025 inch when measured before application of said closure to the container.

9. A capped container according to claim 8 wherein said first thickness is no greater than approximately 0.026 inch when measured before application of said closure to said container.

10. A capped container according to claim 9 wherein said finish of said container has an outside diameter at the location of said at least one helically extending thread of approximately 51 millimeters.

11. A capped container according to claim 10 wherein said shell is formed in a single piece from a sheet of a metallic material.

12. A capped container according to claim 7 wherein said density of said gasket is approximately 58–62 pounds per cubic foot.

13. A package comprising an open top tray and a plurality of capped containers within said tray, each of said capped containers having a height which extends at least to the top of said tray, being adapted to bear at least a part of the weight of a like package superimposed above said package, and comprising:

a container having a finish, said finish having a rim, at least one helically extending thread, a first portion between said at least one helically extending thread and said rim, and a second portion, said at least one helically extending thread being between said second portion and said rim; and a closure sealingly applied to said finish of said container by an axial movement, said closure being adapted to be removed from said container by a rotary movement and comprising;

a shell having a top panel portion and a peripheral skirt portion depending generally normally from an outer portion of said top panel portion, said top panel portion having an inside and an outside, said peripheral skirt portion having an inside and an outside and surrounding said finish of said container including said at least one helically extending thread; and a gasket of an expanded plastisol composition formed in situ along said inside of said peripheral skirt portion and said inside of said top panel portion along said outer portion thereof, said gasket contacting said rim of said container and said finish including said second portion, said gasket having a density of at least approximately 58 pounds per cubic foot and a thickness at a portion of said inside of said outer portion of said top panel portion which is in alignment with said rim of said container, said thickness being measured to said container, of at least approximately 0.024 inch.

14. A package according to claim 13 wherein said gasket has a first thickness at a first location along said inside of said peripheral skirt portion which contacts said first portion of said finish and a second thickness at a second location along said inside of said peripheral skirt portion which contacts said second portion of said finish, and wherein said second thickness is at least approximately 0.025 inch when measured before application of said closure to the container.

15. A package according to claim 14 wherein said first thickness is no greater than approximately 0.026 inch when measured before application of said closure to said container.

16. A package according to claim 15 wherein said finish of said container has an outside diameter at the location of said at least one helically extending thread of approximately 51 millimeters.

17. A package according to claim 16 wherein said shell is formed in a single piece from a sheet of a metallic material.

18. A package according to claim 13 wherein said density of said gasket is approximately 58–62 pounds per cubic foot.

19. A stack of superimposed packages, each of said packages comprising an open top tray and a plurality of capped containers within said tray, each of said capped containers having a height which extends at least to the top of said tray, bearing at least a part of the weight of any other packages in said stack which is superimposed above said each of said packages, and comprising:

a container having a finish, said finish having a rim, at least one helically extending thread, a first portion between said at least one helically extending thread and said rim, and a second portion, said at least one helically extending thread being between said second portion and said rim; and a closure sealingly applied to said finish of said container by an axial movement, said closure being adapted to be removed from said container by a rotary movement and comprising;

a shell having a top panel portion and a peripheral skirt portion depending generally normally from an outer portion of said top panel portion, said top panel portion having an inside and an outside, said peripheral skirt portion having an inside and an outside and surrounding said finish of said container including said at least one helically extending thread; and a gasket of an expanded plastisol composition formed in situ along said inside of said peripheral skirt portion and said inside of said top panel portion along said outer portion thereof, said gasket contacting said rim of said container and said finish including said second portion, said gasket having a density of at least approximately 58 pounds per cubic foot and a thickness at a portion of said inside of said outer portion of said top panel portion which is in alignment with said rim of said container, said thickness being measured, before application of said closure to said container, of at least approximately 0.024 inch.

20. A stack of superimposed packages according to claim 19 wherein said gasket has a first thickness at a first location along said inside of said peripheral skirt portion which contacts said first portion of said finish and a second thickness at a second location along said inside of said peripheral skirt portion which contacts said second portion of said finish, and wherein said second thickness is at least approximately 0.025 inch when measured before application of said closure to the container.

21. A stack of superimposed packages according to claim 20 wherein said first thickness is no greater than approximately 0.026 inch when measured before application of said closure to said container.

22. A stack of superimposed packages according to claim 21 wherein said finish of said container has an outside diameter at the location of said at least one helically extending thread of approximately 51 millimeters.

23. A stack of superimposed packages according to claim 22 wherein said shell is formed in a single piece from a sheet of a metallic material.

24. A stack of superimposed packages according to claim 19 wherein said density of said gasket is approximately 58–62 pounds per cubic foot.

* * * * *